US005090454A

United States Patent [19]

Pierson et al.

[11] Patent Number: 5,090,454

[45] Date of Patent: Feb. 25, 1992

[54] DEWEAVING APPARATUS WITH PNEUMATIC DEFECTIVE PICK RELEASE FOR SHUTTLE-TYPE LOOM

[75] Inventors: Pierre Pierson, Bourgoin Jallieu; Roger Fourneaux, La Tour Du Pin, both of France

[73] Assignee: S. A. Saurer Diederichs (Societe Anonyme), Bourgoin Jallieu, France

[21] Appl. No.: 659,106

[22] Filed: Feb. 21, 1991

[30] Foreign Application Priority Data

Mar. 6, 1990 [FR] France ..... 90 03358

[51] Int. Cl.[5] ..... D03D 47/30; D03D 47/34

[52] U.S. Cl. ..... 139/116.2; 139/446

[58] Field of Search ..... 139/446, 116.2

[56] References Cited

U.S. PATENT DOCUMENTS

| | | | |
|---|---|---|---|
| 4,502,512 | 3/1985 | Suzuki et al. | 139/116.2 |
| 4,821,779 | 4/1989 | Shaw | 139/116.2 |
| 4,941,513 | 7/1990 | Shaw | 139/116.2 |
| 5,016,676 | 5/1991 | Fourneaux et al. | 139/116.2 |
| 5,022,440 | 6/1991 | Velechovsky | 139/116.2 |

*Primary Examiner*—Andrew M. Falik

*Attorney, Agent, or Firm*—Herbert Dubno; Andrew Wilford

[57] ABSTRACT

A weft filament is inserted in a loom by a mechanical shuttle from a feed side as a pick in a weft direction into a shed formed between groups of warp filaments extending and generally traveling in a warp direction. A deweaving system has a loosening nozzle for directing a jet of air against the defective pick in the warp direction for loosening the defective pick from the warp and at least one stripper nozzle situated between the groups of warp filaments for blowing the separated-out defective pick out of the warp against the weft direction to the feed side. A sensor is provided on the feed side for monitoring the pressure of the defective pick outside the shed on the feed side and a controller is connected to the stripping and loosener for, on detection of a defective pick, sequentially operating the loosening and stripper and then restarting the loom.

9 Claims, 4 Drawing Sheets

DEWEAVING APPARATUS WITH PNEUMATIC DEFECTIVE PICK RELEASE FOR SHUTTLE-TYPE LOOM

FIELD OF THE INVENTION

The present invention relates to a deweaving apparatus. More particularly this invention concerns such a device used in a shuttle-type loom.

BACKGROUND OF THE INVENTION

It is known for example from commonly owned U.S. patent application Ser. No. 07/477,359 filed Feb. 7, 1990 U.S. Pat. No. 5,016,676 (European patent application 344,076) to provide a shuttleless loom with a deweaving system that allows a misfed or broken pick to be removed from the warp. Such an arrangement is connected with means for detecting a break or misfeed of a pick so that it automatically stops the loom and removes the bad pick. It can even be associated with a device that switches over to another weft supply in the event that the bad pick was made because of problems with its supply.

Such an arrangement works with the pneumatic equipment already present on a shuttleless loom which invariably uses jets of air to convey the weft across the warp. Other such devices for shuttleless or jet-type looms are shown in European published application 309,013 filed by D. Lewyllie based on a Belgian priority of Aug. 26, 1987 and 318,861 filed by P. Velechovsky based on a Czechoslovakian priority Dec. 12, 1987.

The structure is different with a shuttle-type loom, in particular of the standard type having a pair of needle-type grippers that can be moved to the center of the shed so that the gripper holding the leading end of the weft yarn advances it to the center of the shed and hands it off to the other oppositely advanced gripper which pulls it all the way through as the first gripper retracts oppositely. Here a weft break normally results in the loom being shut down. Then the bad pick is removed manually, the weft is rethreaded in its guide, and the machine is restarted. Separating the bad pick from the warp, pulling it out of the shed, monitoring its complete removal, and keeping track of the weft end outside the loom are all fairly difficult problems in such a shuttle-type loom to which no satisfactory solution currently exists.

OBJECTS OF THE INVENTION

It is therefore an object of the present invention to provide a deweaving system for a shuttle-type loom.

Another object is the provision of such a deweaving system for a shuttle-type loom which overcomes the above-given disadvantages, that is which operates surely and accurately so as to strip out a bad pick wholly automatically.

SUMMARY OF THE INVENTION

The instant invention is used in a loom wherein a weft filament is inserted by a mechanical shuttle from a feed side as a pick in a weft direction into a shed formed between groups of warp filaments extending and generally traveling in a warp direction. It is a deweaving system having a loosening nozzle for directing a jet of air against the defective pick in the warp direction for loosening the defective pick from the warp and at least one stripper nozzle situated between the groups of warp filaments for blowing the separated-out defective pick out of the warp against the weft direction to the feed side. A sensor is provided on the feed side for monitoring the presence of the defective pick outside the shed on the feed side and a controller is connected to the stripping and loosener for, on detection of a defective pick, sequentially operating the loosening and stripping unit and then restarting the loom.

Thus by using a pneumatic system that itself is known it is possible to provide deweaving capacity in a shuttle-type loom that hitherto was not normally capable of being so equipped. The basic idea of the invention is to remove the defective pick and/or pieces thereof not in the direction in which it is inserted, but in the opposite direction toward the feed side of the weft. This has the enormous advantage that it avoids the necessity of having to cut the defective piece of weft off its supply so that the loom can be restarted without problems.

According to the invention the loosening unit includes a loosening nozzle reciprocal in the weft direction across the full width of the warp and the stripping nozzle blows the defective pick along inside the shed to the feed side. The shed is a passage that extends in the weft-insertion direction and that is laterally delimited, relative to the warp-displacement direction, at the upstream side by the reed or beating-in comb, above and below by the separate groups of warp filaments spread to form the shed, and downstream by the joined warp filaments and the most recently inserted weft pick. More particularly, there is a plurality of stripping nozzles directed toward the feed side in the weft direction and spaced apart in the weft direction and the loom is provided with guides spaced apart in the weft direction with the stripping nozzles mounted on these guides.

In accordance with further features of the invention another nozzle is provided for deflecting the stripped defective pick transverse to the weft direction and a trap is provided for catching and receiving the deflected defective pick. The deflecting nozzle is directed transversely of the weft direction and the catching unit and the trap include a catching hood confronting the deflecting nozzle. An optoelectric sensor is provided in the hood for detecting the presence of a removed defective pick.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
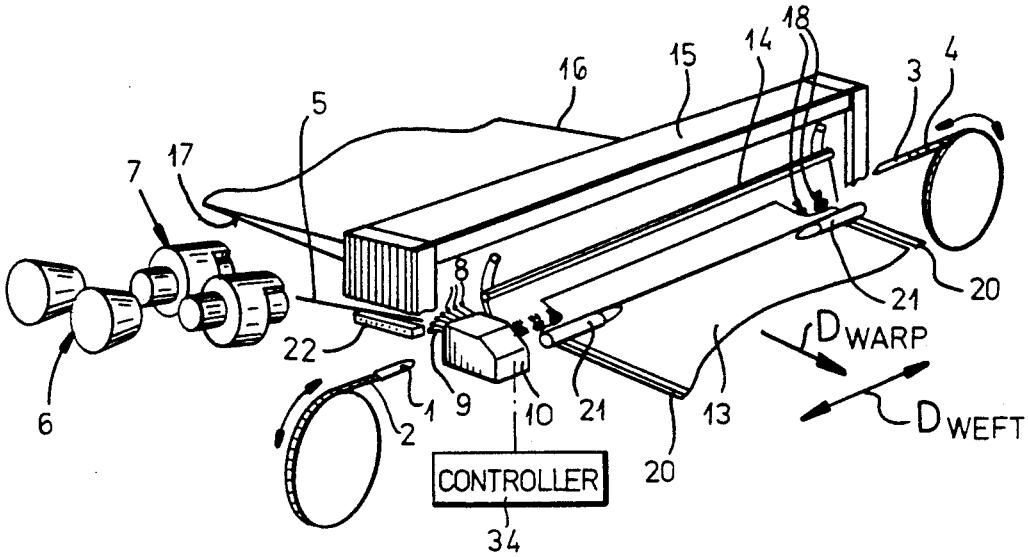
FIG. 1 is a partly diagrammatic perspective view of a loom equipped for deweaving according to the invention.
Figure 3:
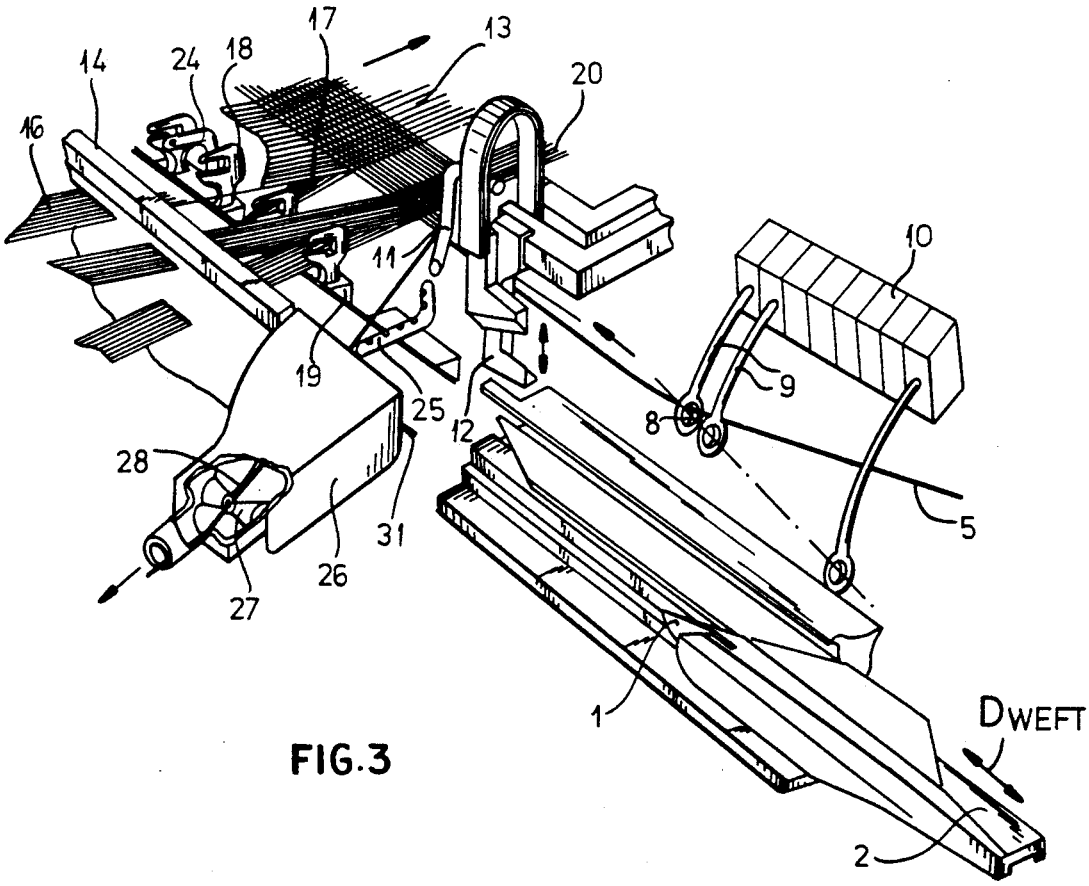
FIG. 3 is a further yet larger-scale perspective view of the detail of the loom.
Figure 2:
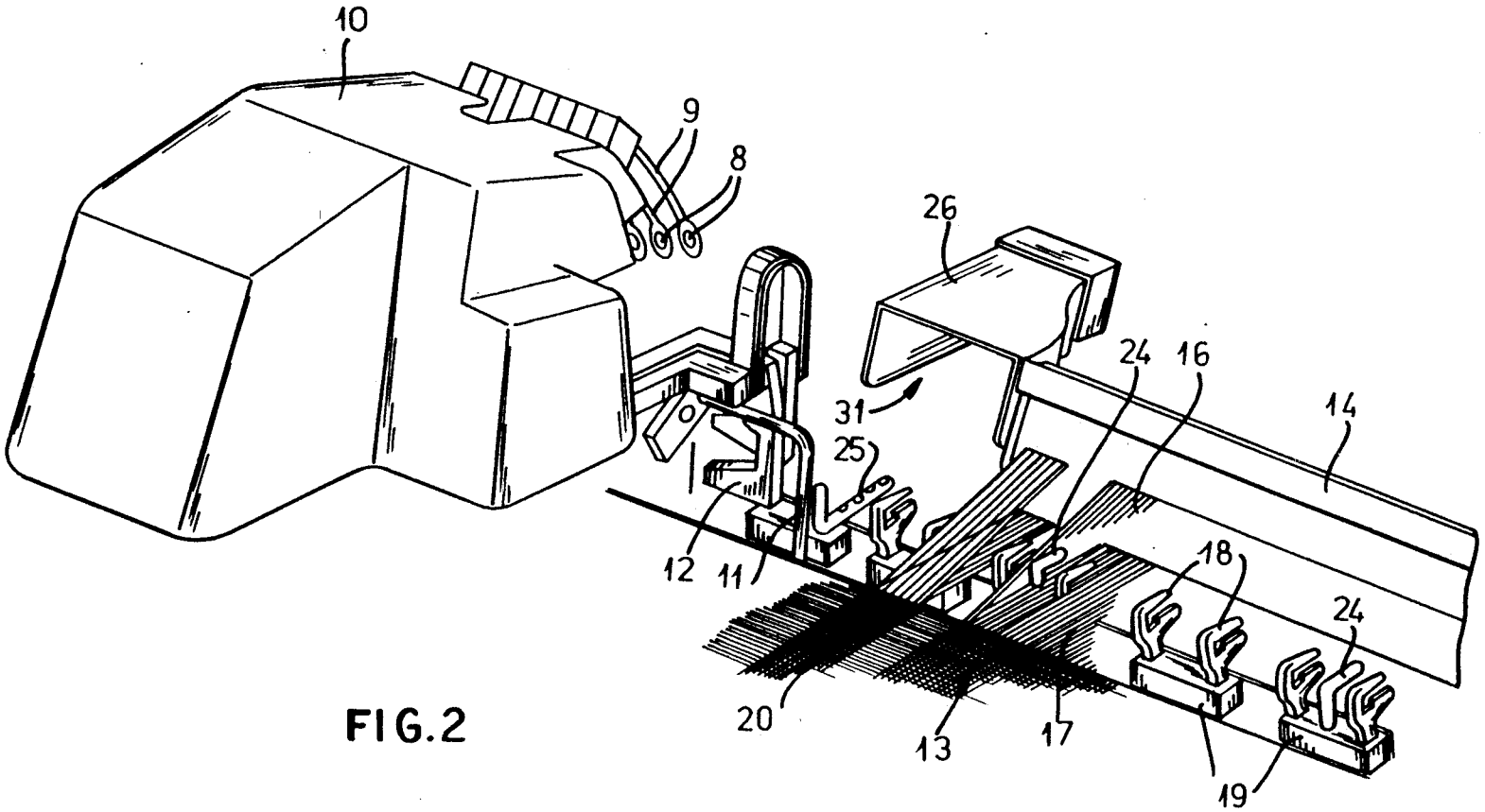
FIG. 2 is another larger-scale perspective view of a detail of the loom.

As seen in FIGS. 1 through 3 the loom according to this invention has two shuttle needles or grippers 1 and 3 carried as is known on respective ribbons 2 and 4 for movement in a transverse weft direction $D_{weft}$. Weft threads or yarns 5 are pulled from respective supplies 6 through respective feeders 7 and then through respective eyes 8 of needles 9 operated by a weft selector 10 and can be gripped by the shuttles 1 and 3. Upstream of the selector needles 9 the weft filament 5 passes over a deflecting finger 11 located adjacent a scissor device 12. All these elements are on the so-called feed side of the goods.

In addition the loom has a reed 14 for beating the weft 5 into the warp formed by a pair of warp ends 16 and 17 both moving in a warp direction $D_{warp}$ that is horizontal and perpendicular to the weft direction $D_{weft}$. A heddle arrangement 15 of standard construction is provided to form the shed in the warps 16 and 17. The ribbons 2 and 4 move along guides 18 held on supports 19 spaced along the weft direction $D_{weft}$. Selvedges 20 of the goods 13 have their own guides 21.

Under normal operating conditions the upstream (relative to direction $D_{weft}$) shuttle 1 advances the leading or free end of the selected weft yarn 5 to the middle of the shed and passes it off to the downstream shuttle 3 which has, to this end, been advanced oppositely to the shed middle. The shuttle 3 pulls the selected yarn 5 out of the shuttle 1 to the pick side of the goods 13 and the feed-side scissors 12 cuts the yarn. Then the comb or reed 14 beats in the thus installed pick and the cycle can be repeated with the same or a different yarn 5.

According to this invention the loom is provided with a piezoelectric defective-weft sensor 22 of the type described in the above-cited U.S. patent application for detecting whether the inserted weft 5 is broken or there has been a weft misfeed, leaving for instance a broken weft end 28 (FIG. 4) and/or a broken weft piece 29 in the shed. To remove such weft elements 28 and 29 the device is provided with a loosening nozzle 23 (FIG. 4) which can be reciprocated in the weft direction $D_{weft}$ across the full width of the goods 13 and which is connected to an air supply 32 and to an actuator 33 in turn operated by a centralized controller 34 (FIG. 1). The air jet from this nozzle 23 is directed in the warp direction $D_{warp}$ but opposite to the direction in which the goods 13 are moving so that it can free a pick from the two sets 16 and 17 of warp ends.

The system of this invention further has nozzles 24 carried on the supports 19 of the guides 18. These nozzles 24 are connected by unillustrated conduits to the air source 32 so that they can direct respective jets 30 of compressed air in the weft direction $D_{weft}$ toward the feed side of the shed. The nozzles 24 are equispaced across the goods 13 in the direction $D_{weft}$ to ensure that any loosened pick will be pushed all the way back to the feed side. At this feed side level with the deflecting pin 11 is a sideways deflecting nozzle 25 also connected to the air source 32 and having jets directed back against the warp direction $D_{warp}$ into a mouth 31 of a catch hood or trap 26 provided internally with photoelectric sensors 27 connected to the controller 34.

Figure 4:
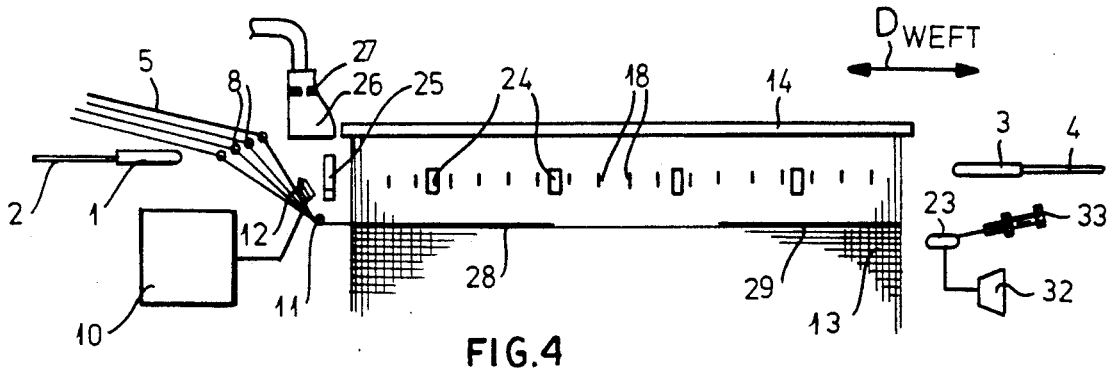
FIGS. 4 through 10 are small-scale partly diagrammatic top views illustrating the operation of the system of this invention.
Figure 5:
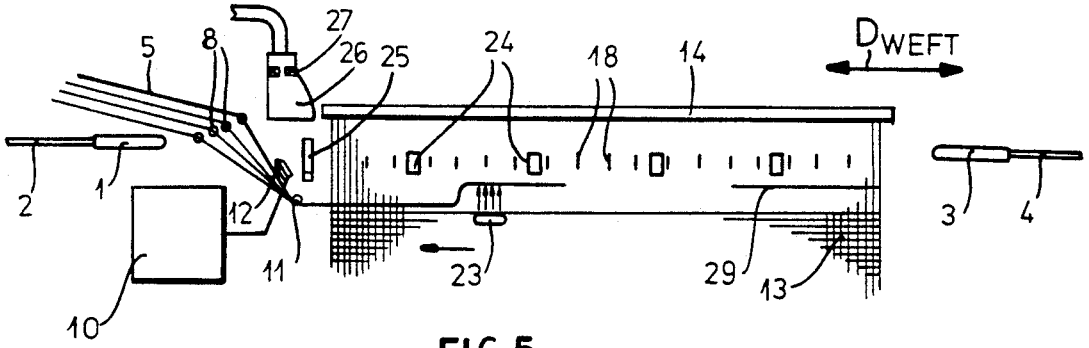
Figure 6:
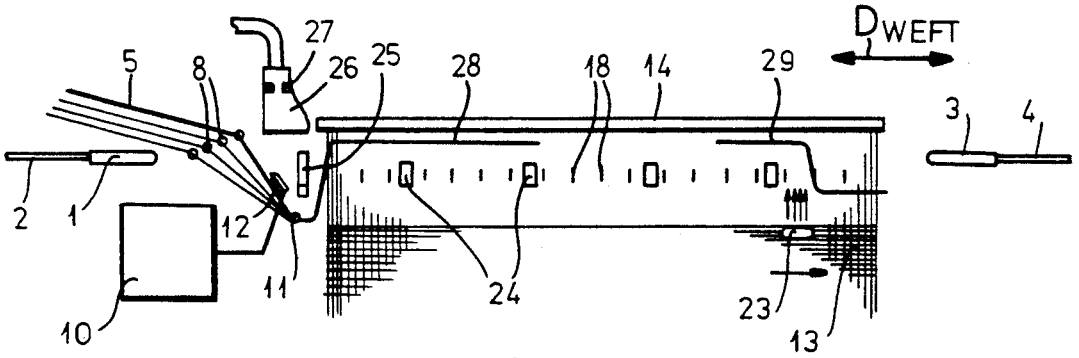

As seen in FIGS. 4 through 10, the system described above operates as follows:

As soon as the sensor 22 detects that a pick has misfed, leaving for instance a piece 29 and a free end 28 of the yarn 5 in the shed as indicated in FIG. 4, it operates the actuator 33 and air source 32 to sweep the loosening nozzle 23 back and forth across the goods 13 in the shed 13. This action as shown in FIGS. 5 and 6 pushes the weft pieces 28 and 29 upstream in the direction $D_{warp}$ so that they are not tightly held by the warp or weft of the goods 13 and so that they are upstream of the nozzles 24.

Figure 7:
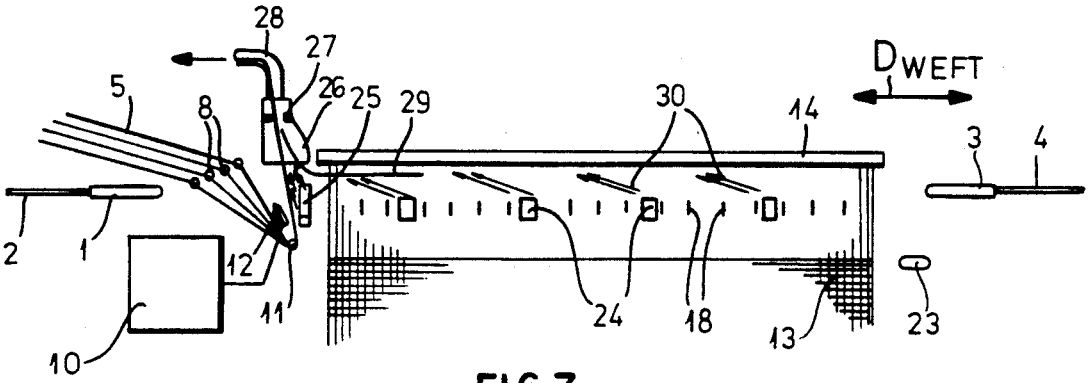
Figure 8:
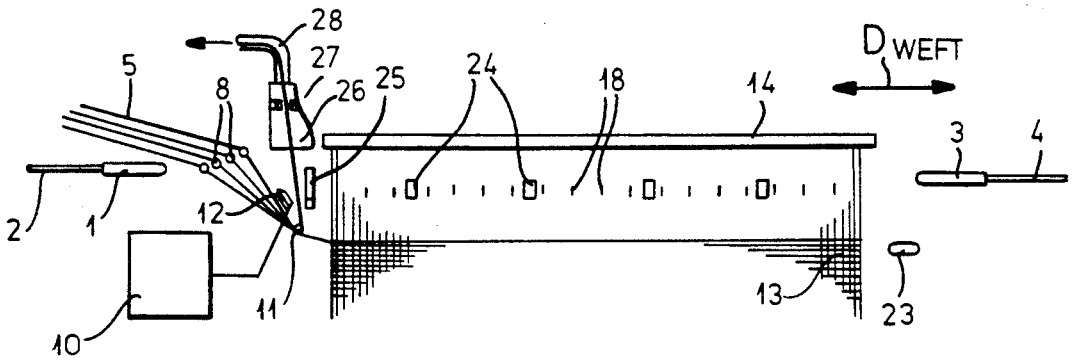

Then as seen in FIG. 7 the nozzles 24 and 25 are pressurized to emit jets 30 of air. This causes the pieces 28 and 29 to be blown transversely upstream in direction $D_{weft}$ to the feed side and then back upstream in direction $D_{warp}$ into the mouth 31 of the catching hood 26. FIG. 8 illustrates how this leaves the weft end 28 stretched around the deviating finger 11 and extending into the hood 26. The sensors 27 have meanwhile detected the passage of the broken piece 29 and now detect the continuous presence of the end 28.

Figure 9:
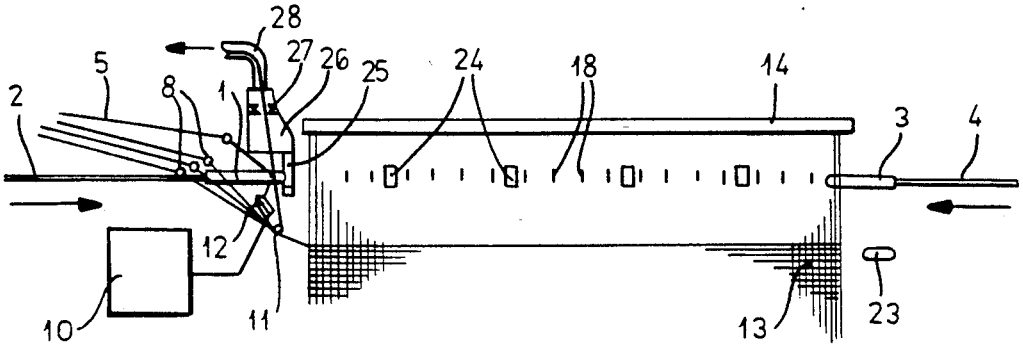
Figure 10:
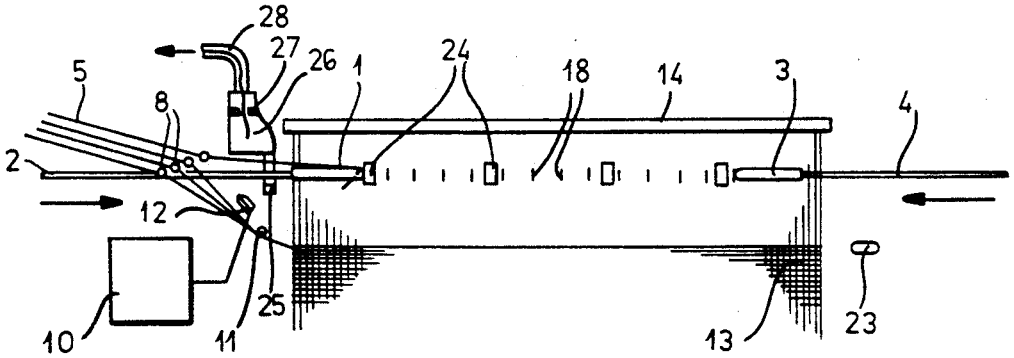

Subsequently as seen in FIG. 9 the loom is restarted by the controller 34 and the shuttles 1 and 3 are advanced. The shuttle 1 picks up the weft filament 5 to be inserted in the shed and the scissors 12 cut off the bad end 28 which is then sucked into the aspirator 26.

We claim:

1. In a loom wherein a weft filament is inserted by a mechanical shuttle from a feed side as a pick in a weft direction into a shed formed between groups of warp filaments extending and generally traveling in a warp direction, a deweaving system for removing a defective pick, the system comprising:

means for directing a jet of air against the defective pick in the warp direction for loosening the defective pick from the warp;

stripping means situated between the groups of warp filaments for blowing the separated-out defective pick out of the warp against the weft direction to the feed side;

means on the feed side for monitoring the pressure of the defective pick outside the shed on the feed side; and control means connected to the stripping and loosening means for, on detection of a defective pick, sequentially operating the loosening and stripping means and then restarting the loom.

2. The deweaving system for a shuttle-type loom defined in claim 1 wherein the loosening means includes a loosening nozzle, and means for reciprocating the loosening nozzle in the weft direction across the full width of the warp.

3. The deweaving system for a shuttle-type loom defined in claim 1 wherein the stripping means includes means for blowing the defective pick along inside the shed to the feed side.

4. The deweaving system for a shuttle-type loom defined in claim 3 wherein the stripping means includes a plurality of stripping nozzles directed toward the feed side in the weft direction and spaced apart in the weft direction.

5. The deweaving system for a shuttle-type loom defined in claim 4 wherein the loom is provided with guides spaced apart in the weft direction, the stripping nozzles being mounted on the guides.

6. The deweaving system for a shuttle-type loom defined in claim 1, further comprising:

means including a deflecting nozzle for deflecting the stripped defective pick transverse to the weft direction; and means confronting the deflecting nozzle for catching and receiving the deflected defective pick.

7. The deweaving system for a shuttle-type loom defined in claim 6 wherein the deflecting means includes a deflecting nozzle on the feed side directed transversely of the weft direction and the catching and receiving means includes a catching hood confronting the deflecting nozzle.

8. The deweaving system for a shuttle-type loom defined in claim 7 wherein the monitoring means includes an optoelectric sensor in the hood.

9. A method of deweaving and removing a defective pick in a loom wherein a weft filament is inserted by a mechanical shuttle from a feed side as a pick in a weft direction into a shed formed between groups of warp filaments extending and generally traveling in a warp direction, the method comprising the steps of:

directing a jet of air against the defective pick in the warp direction for loosening the defective pick from the warp;

blowing the separated-out defective pick out of the warp along the shed against the weft direction to the feed side;

monitoring the presence of the defective pick outside the shed on the feed side; and on detection of a defective pick outside the warp on the feed side restarting the loom.

* * * * *